US007284877B2

(12) United States Patent
Haugaard et al.

(10) Patent No.: US 7,284,877 B2
(45) Date of Patent: Oct. 23, 2007

(54) INDUSTRIAL LIGHT FIXTURE WITH SPRING-SPACER APPARATUS

(75) Inventors: Eric J. Haugaard, Kenosha, WI (US); Kurt Wilcox, Libertyville, IL (US)

(73) Assignee: Ruud Lighting, Inc., Racine, WI (US)

( * ) Notice: Subject to any disclaimer, the term of this patent is extended or adjusted under 35 U.S.C. 154(b) by 116 days.

(21) Appl. No.: 11/196,047

(22) Filed: Aug. 3, 2005

(65) Prior Publication Data

US 2007/0030682 A1 Feb. 8, 2007

(51) Int. Cl.
*F21S 8/00* (2006.01)

(52) U.S. Cl. ..... 362/147; 362/150; 362/294; 362/373; 362/404

(58) Field of Classification Search ..... None
See application file for complete search history.

(56) References Cited

U.S. PATENT DOCUMENTS

| | | | | |
|---|---|---|---|---|
| 4,490,649 | A | 12/1984 | Wang | |
| 4,503,358 | A | 3/1985 | Kamei et al. | |
| 4,649,320 | A | 3/1987 | Hough et al. | |
| 4,748,380 | A | 5/1988 | MacDonald et al. | |
| 5,136,493 | A | 8/1992 | Straus et al. | |
| 5,548,497 | A | 8/1996 | Cho | |
| 5,597,233 | A | 1/1997 | Lau | |
| 5,691,598 | A | 11/1997 | Belle et al. | |
| 6,064,155 | A | 5/2000 | Maya et al. | |
| 6,174,074 | B1 | 1/2001 | Lahijani | |
| 6,204,602 | B1 | 3/2001 | Yang et al. | |
| 6,394,869 | B1 | 5/2002 | Haugaard et al. | |
| 6,467,927 | B1 | 10/2002 | Haugaard et al. | |
| 6,601,975 | B1 | 8/2003 | Haugaard et al. | |
| 2007/0081345 | A1 * | 4/2007 | Wilcox et al. | 362/382 |

* cited by examiner

*Primary Examiner*—Renee Luebke
*Assistant Examiner*—Kristen A Manskar
(74) *Attorney, Agent, or Firm*—Jansson Shupe & Munger Ltd.

(57) ABSTRACT

An industrial light fixture of the type including a housing with a base member and a top member and containing power-related components includes spring-spacer apparatus between the base member and the ballast, such that, with the top member closed with respect to the base member, the spring-spacer apparatus biases the ballast into heat-exchange engagement with at least one surface of the top member and provides an air gap between the ballast and the base member. The base member and top member are preferably formed of die-cast metal and a variety of preferred features are disclosed.

35 Claims, 7 Drawing Sheets

INDUSTRIAL LIGHT FIXTURE WITH SPRING-SPACER APPARATUS

FIELD

The field relates generally to industrial light fixtures, such as overhead industrial light fixtures, and more specifically to industrial light fixtures having high-intensity discharge lamps.

BACKGROUND

Many different overhead industrial light fixtures exist to serve needs such as factory and warehouse illumination and the like, and a number of advances have been made over the years. Among significant advances in industrial light fixtures are the fixtures disclosed in U.S. Pat. Nos. 6,601,975 (Overhead Industrial Light Fixture With Two-Piece Housing); 6,394,869 (Method for Manufacture of Overhead Industrial Light Fixture); and 6,467,927 (Overhead Industrial Light Fixture With Mounted Reflector), all of Ruud Lighting, Inc. Such fixtures provide significant advantages, including compactness, simplicity of manufacture, ease of installation and service, pleasing appearance, and other advantages set forth in the disclosures.

Despite these and other such advances in the field there remains a need for further improvement in industrial light fixtures, preferably without compromising the advantages previously provided including those related to ease of manufacture, storage, shipment, installation, etc.

One concern of particular significance is that overhead industrial light fixtures of the prior art are predisposed to a variety of problems associated with overheating. Overheating can damage power-related components (e.g., capacitors) which ultimately compromises the longevity of the light fixture and its components. Among the overheating problems with certain devices of the prior art is a problem of inadequate heat dissipation away from power-related components, such as ballasts, lamps and lamp sockets.

Another problem is that certain structures of the prior art may not be particularly well-adapted to suppress and/or contain any combustion that might occur. In certain cases, the nature of the ballast (including manufacturing defects or minimal defects that may occur from handling or the like) or improper electrical characteristics or conditions can lead to ballast failures and shorts which in turn lead to combustion of materials (e.g., organic insulation materials). As can be seen, the goals of achieving cooling and suppressing oxidation in an industrial light fixture tend to be at odds with each other. Accomplishing one of these critical goals tends to lead to loss of the other. The benefits realized in being able to accomplish these two goals in one fixture would be significant.

For one thing, facilitating cooling of the industrial light fixture tends to keep the components cool thereby enhancing the life of the components and the entire fixture and preserving overall quality. And, substantially reducing the inflow and outflow of combustion-supporting air in critical portions of an industrial light fixture would tend to suppress and limit any combustion which might occur, and thus reduce dangers typically associated with product failures. If these critical advantages could be combined in an industrial lighting fixture, the resulting fixture would have improved quality, endurance and longevity.

Ballasts, the electrical components required to start and maintain operation of lighting fixtures, are prone to overheating. During regular operation, the ballast produces considerable heat and often receives heat from the lamp it serves. When overheating of the ballast occurs, it can cause breakdown of the ballast core. It would, therefore, be particularly important in the design of an overhead industrial light fixture to achieve maximum heat dissipation from the ballast and to thermally separate the ballast from the heat of the lamp, while at the same time facilitating containment of any combustion which might occur upon ballast failure.

While the concern of overheating has in some cases been addressed by use of baffles and other insulating features, such approaches increase manufacturing costs and comprise the desirable goal of compactness and ease of service. Plastic ballast enclosures may be used to insulate the ballast; however, such enclosures are contrary to heat removal and can exacerbate problems. In many other cases, this concern has led to inclusion of thermal protection devices to break circuits upon any overheating. However, in the case of thermal protection devices, under certain conditions, such devices may fail to perform properly thereby allowing a lighting fixture to overheat and possibly lead to combustion. Such thermal protection devices also add cost.

Another possible approach to dealing with certain of the above problems and shortcomings is use of a housing with one or more external power-related components, such as the ballast. However, this approach complicates installation, increases cost, makes achieving a pleasing appearance difficult at best, and is directly contrary to the goal of compactness.

The subject matter described herein is directed to one approach to overcoming the aforementioned problems and shortcomings.

OBJECTS

It is an object to provide an improved overhead industrial light fixture overcoming some of the problems and shortcomings of the prior art.

Another object is to provide an overhead industrial light fixture which facilitates dissipation of heat from the housing of the overhead industrial light fixture into the atmosphere.

Another object is to provide an overhead industrial light fixture which is less susceptible to combustion.

Another object is to provide an overhead industrial light fixture which is well-adapted to contain any combustion that might occur.

Another object is to provide an improved overhead industrial light fixture that is inexpensive to manufacture and easy to install.

Still another object is to provide an improved overhead industrial light fixture which is compact and yet free of problems of overheating critical components.

SUMMARY

The subject matter described herein represents an improvement in overhead industrial light fixtures of the type including a housing, power-related components and a lamp-mounting socket. The type of overhead industrial light fixture to which this improvement applies has a housing including a base member and a top member together forming a space, power-related components including at least a ballast in the space on the base member, and a lamp-mounting socket secured with respect to the base member.

In the improvement, spring-spacing apparatus is positioned between the base member and the ballast such that, with the top member closed with respect to the base member, the spring-spacer apparatus biases the ballast into heat-exchange engagement with at least one surface of the top member. This provides an air gap between the ballast and the base member and holds the ballast in place while allowing preferential heat transfer to the top member and dissipation therefrom into the atmosphere.

In highly preferred embodiments, both the base member and the top member are formed of die-cast metal. In particularly preferred die-cast structures, the base member and the top member are configured to provide mating engagement thereby forming a substantially enclosed space. At the same time, this also allows essentially unrestricted inflow and outflow of air to cool the power-related components within the housing.

The spring-spacer apparatus is preferably a leaf-spring spacer. Such leaf-spring-spacer is a plate with a plurality of locator features adapted to engage and position the ballast.

In highly preferred embodiments, the top member includes a top wall and downwardly-extending, space-surrounding sidewalls integral with the top wall. The spring-spacer apparatus biases the ballast into heat-exchange engagement with the top wall.

It is most preferred that the sidewalls include an endwall adjacent to a first side of the ballast. The base member preferably includes a first upwardly-extending surface opposed to the endwall and adjacent to a second side of the ballast that is opposite the first side thereof. The spring-spacer apparatus biases the ballast into heat-exchange engagement with the endwall.

The spring-spacer apparatus preferably includes a first spring-spacer member under the ballast which biases the ballast into contact with the top wall. A second spring-spacer member between the first upwardly-extending surface of the base member and the second side of the ballast biases the ballast into contact with the endwall. In highly preferred embodiments, each of the first and second spring-spacer members is a leaf-spring spacer. In preferred embodiments of the type in which the ballast is biased against the endwall, the base member has an upwardly-extending middle portion integral therewith that forms a housing recess and the first upwardly-extending surface of the base member. The lamp socket is in the recess formed by the upwardly-extending middle portion of the base member. And a portion of the spring-spacer apparatus is between the first upwardly-extending surface and the second side of the ballast, as already described. This arrangement allows the spring-spacer apparatus to provide thermal isolation in the middle portion of the base from the ballast.

In certain highly preferred embodiments, the top member is hinged with respect to the base member such that hinging motion of the top member upon closing the housing pushes the ballast against the spring-spacer apparatus. The base member and the top member having first and second mating hinge members each integrally formed therewith along the adjacent edges thereof.

As used herein, the following terms have the meanings given below, unless the context requires otherwise:

In referring to an overhead industrial light fixture, the term "overhead" refers to fixtures which are typically mounted, directly or indirectly, on ceilings or overhead structural members of some sort, such as in factories, warehouses, etc. (regardless of purpose), or any other overhead structure put in place for the purpose of supporting a light fixture. The term "industrial" is used in order to differentiate from residential lighting or the like. Neither of these terms is to be taken as limiting.

The term "power-related components" includes ballasts, capacitors, ignitors and other devices for creating the proper electrical operating characteristics usable for a selected lamp, such as high-intensity discharge (HID) lamps of various kinds.

The term "ballast" as used herein is defined as a power regulating device commonly referred to as, for example, a ballast, a high reactant ballast, or a constant wattage auto transformer, etc.

The term "substantially enclosed," as used with respect to space within the housing, means closed in the sense that inflow and outflow of air are impeded even if the space is not fully and effectively sealed. The impeding of air flow is such as would serve to suppress combustion if it were to occur.

The terms "top" and "base" used herein with reference to the fixture, or parts thereof, assume the normal use orientation of the fixture. The simplicity of the housing retains certain advantages, including ease of manufacturing and service, compactness, pleasing in appearance, and ease of assembly, as disclosed in U.S. Pat. No. 6,394,869 (Method For Manufacture of Overhead Light Fixture)

The overhead industrial light fixture described herein, in its various forms, overcomes certain problems and shortcomings of the prior art, including those referred to above.

BRIEF DESCRIPTION OF THE DRAWINGS

The drawings illustrate preferred embodiments which include the above-noted characteristics and features of the overhead industrial light fixture described herein. The invention will be readily understood from the descriptions and from the drawings, in which.

DETAILED DESCRIPTION OF PREFERRED EMBODIMENTS

Figure 2:
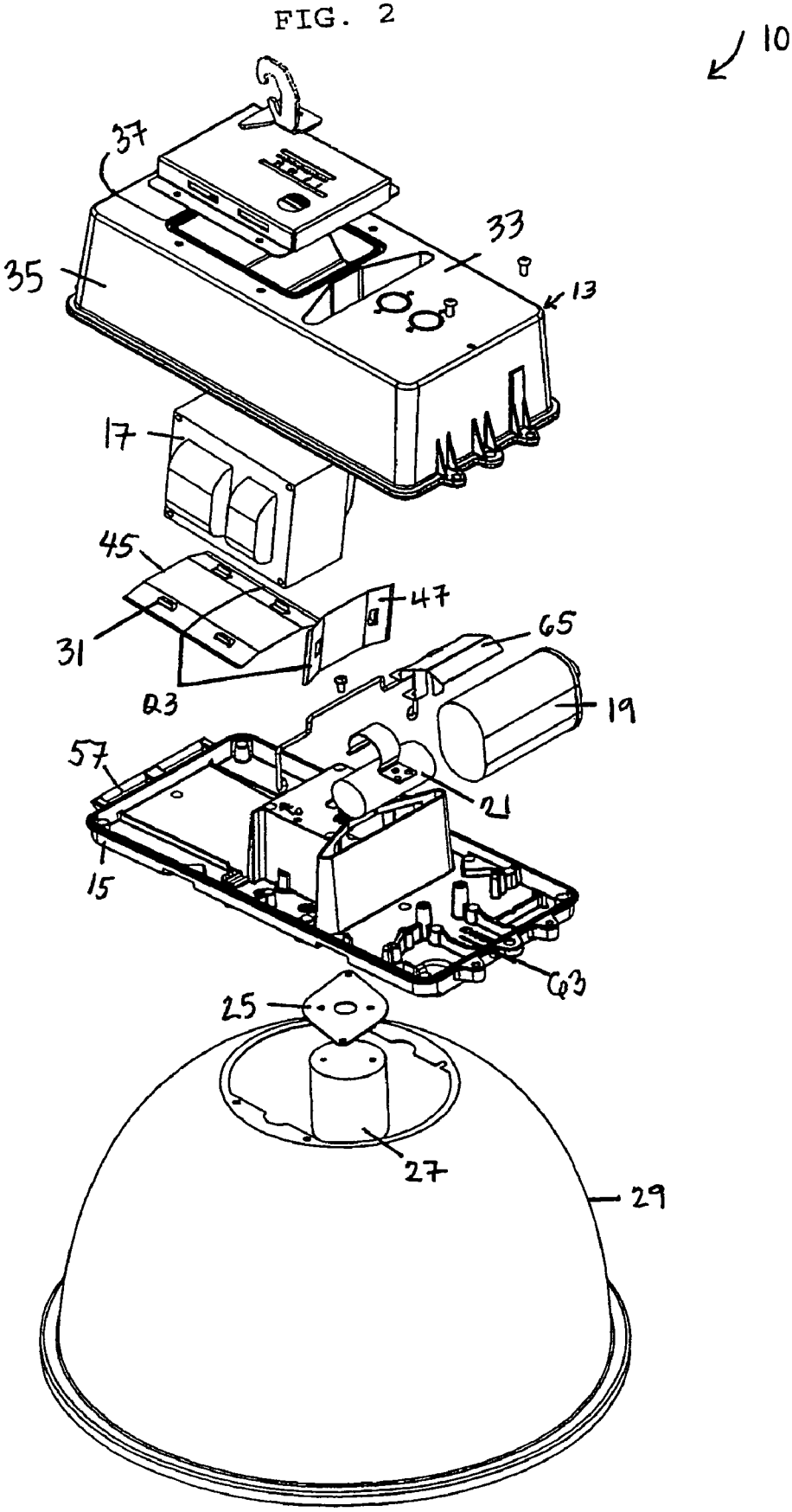
FIG. 2 is an exploded perspective view of the device of FIG. 1.
Figure 3:
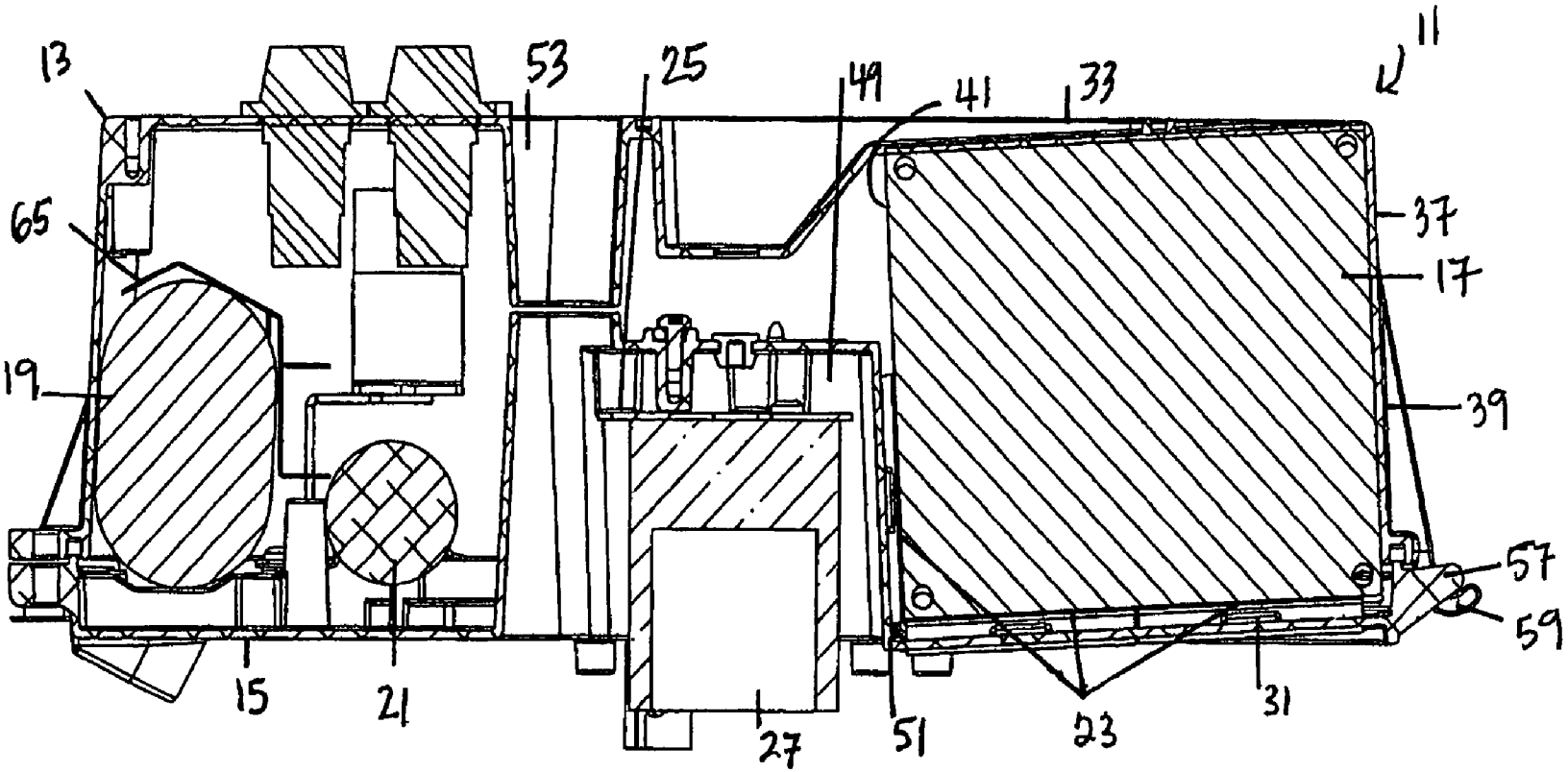
FIG. 3 is a cross-section of the housing of the device in FIG. 1.

The drawings illustrate an overhead industrial light fixture 10 which includes: a housing 11 with a top member 13 and a base member 15; power-related components including a ballast 17, a capacitor 19, and an ignitor 21; spring-spacer apparatus 23; a socket mount 25; a lamp-mounting socket 27; and a reflector 29. Such elements are best seen in FIGS. 2-3.

Figure 1:
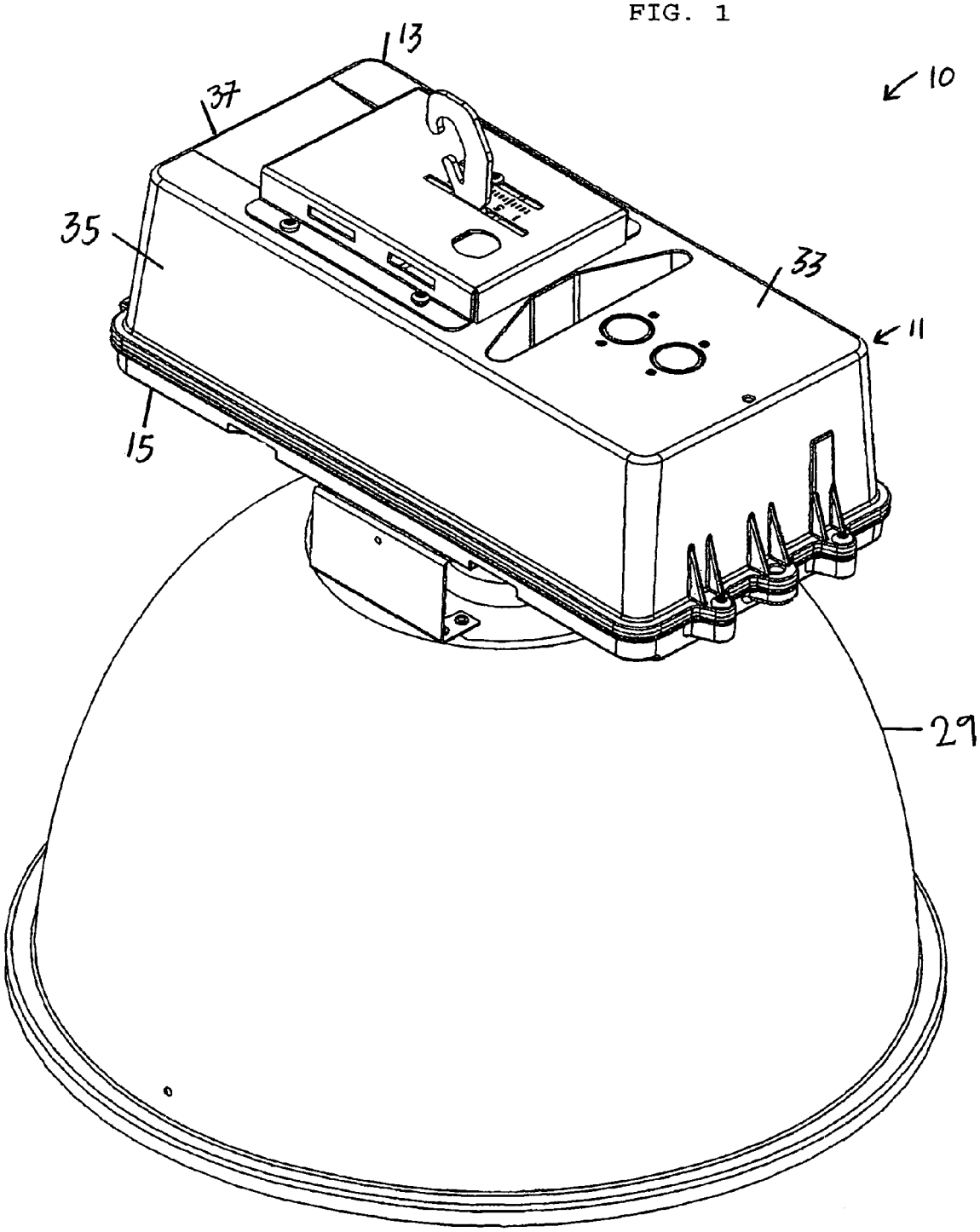
FIG. 1 is a perspective view of a preferred industrial light fixture in accordance with this invention.
Figure 4:
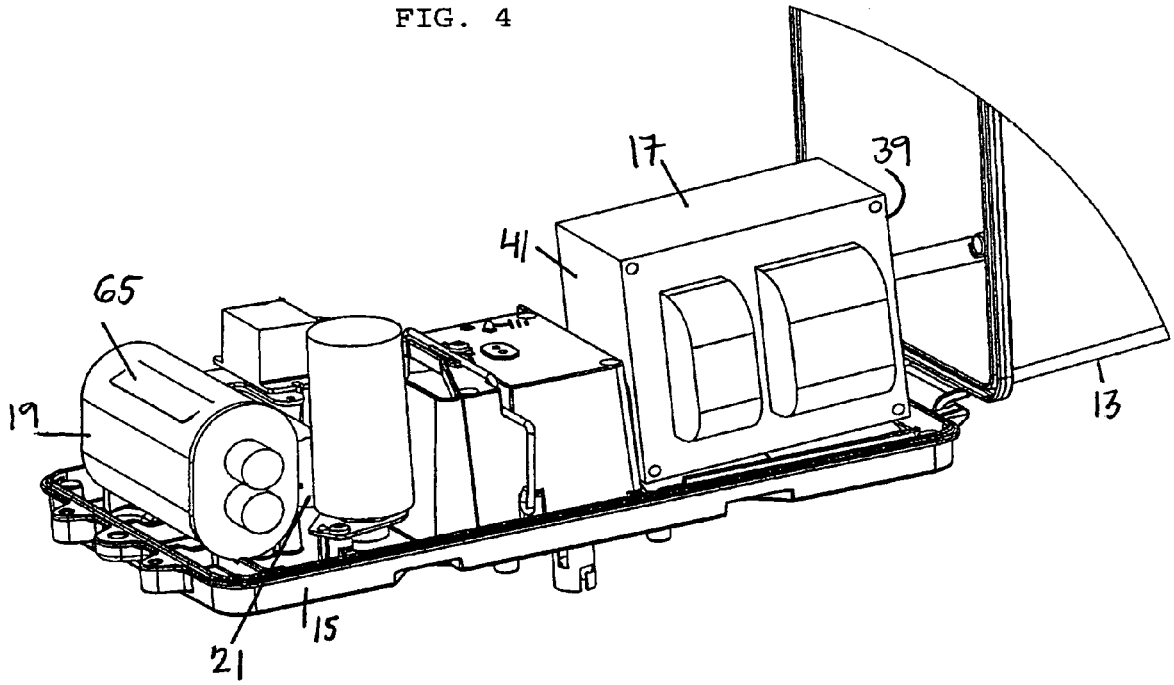
FIG. 4 is a top perspective view of the base member of the housing of the device of FIG. 1. In this perspective, the ballast is not installed, showing the position of spring-spacer apparatus.
Figure 5:
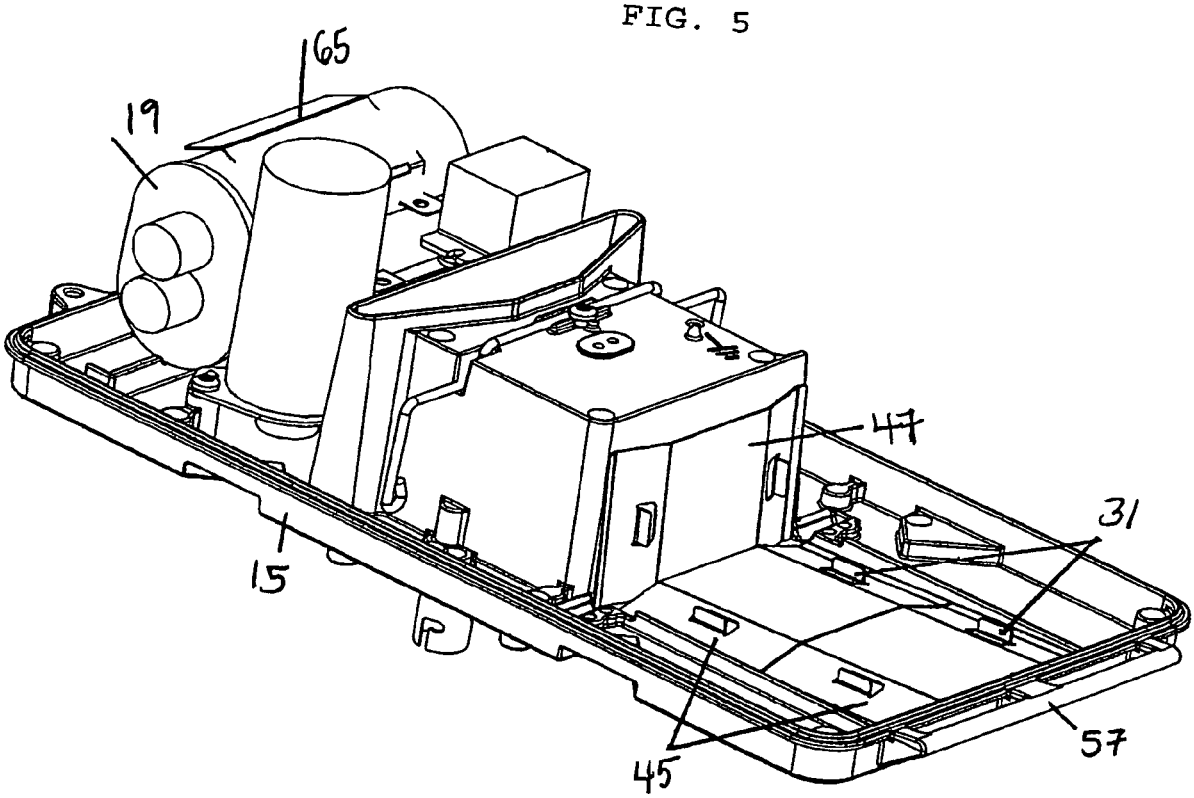
FIG. 5 is further top perspective view of the base member of the housing of the device of FIG. 1.
Figure 6:
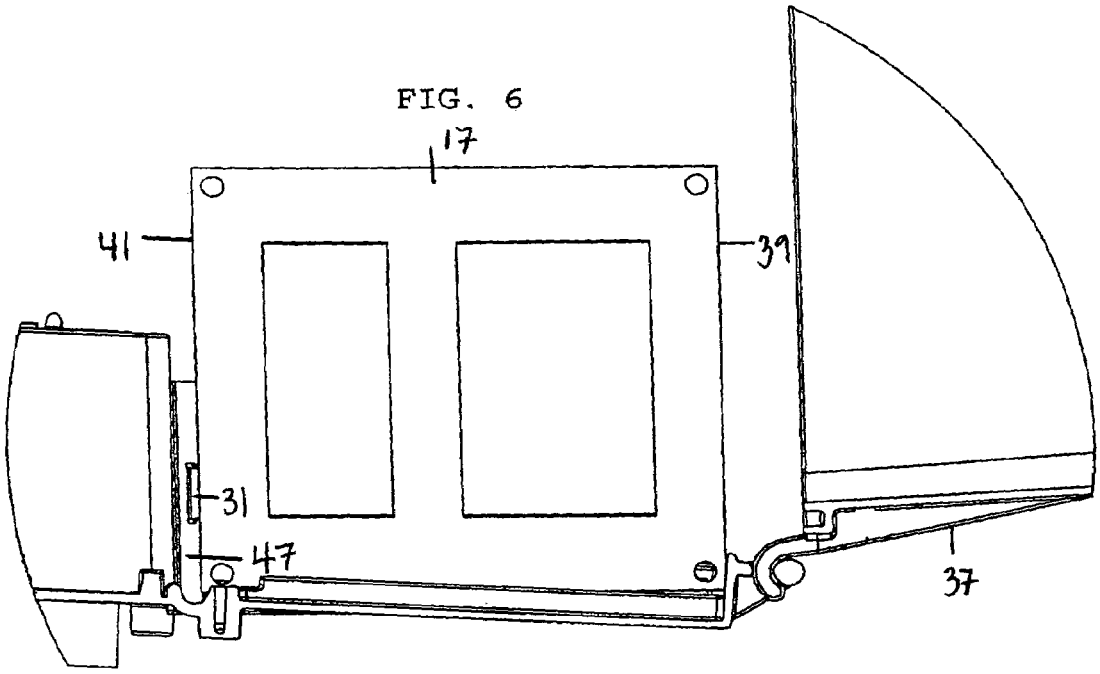
FIG. 6 is partial cross-section of the housing of the device in FIG. 1.
Figure 7:
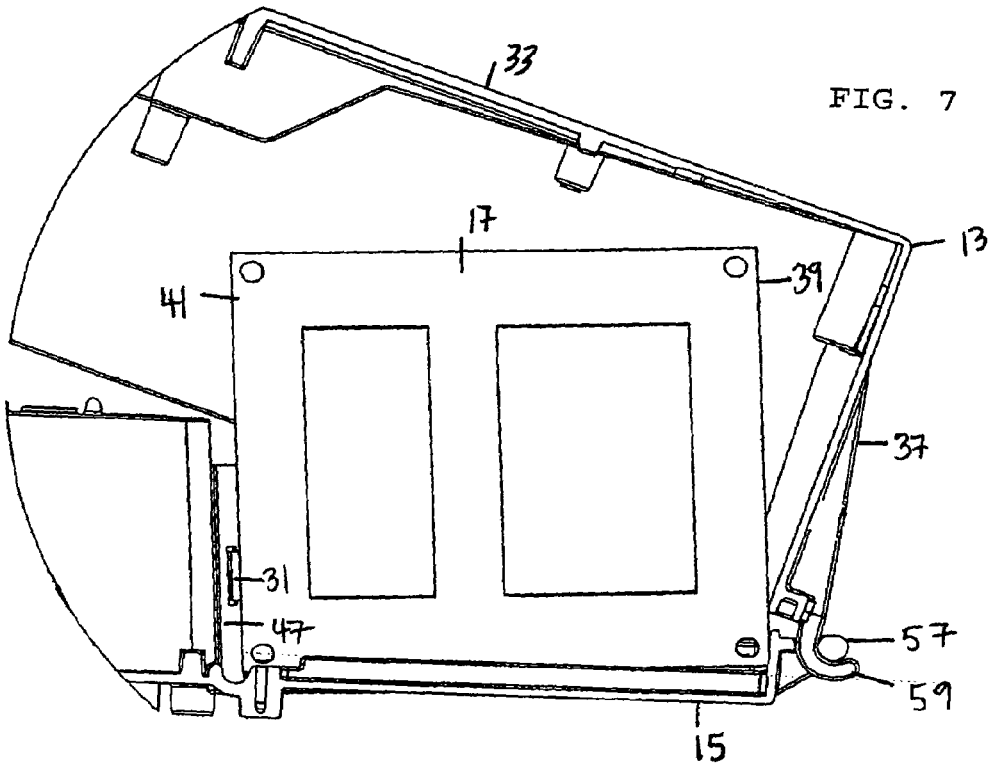
FIG. 7 is further partial cross-section of the housing of the device in FIG. 1.
Figure 8:
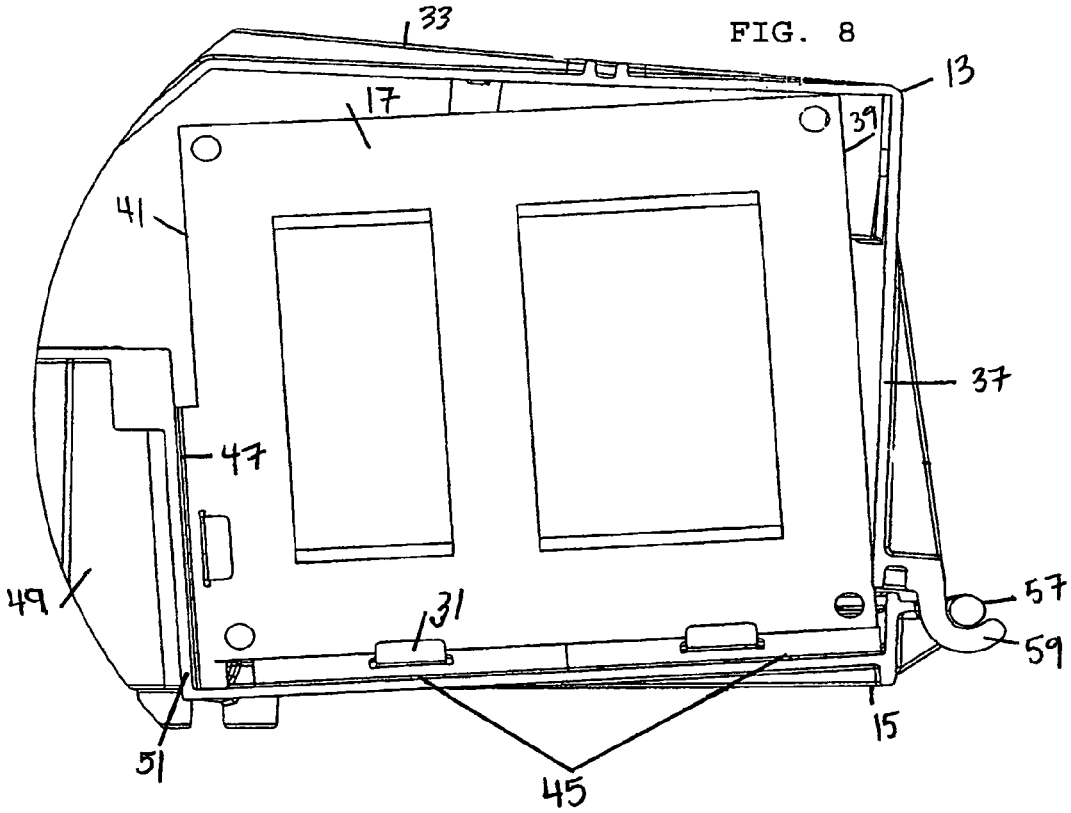
FIG. 8 is another partial cross-section of the housing of the device in FIG. 1.
Figure 9:
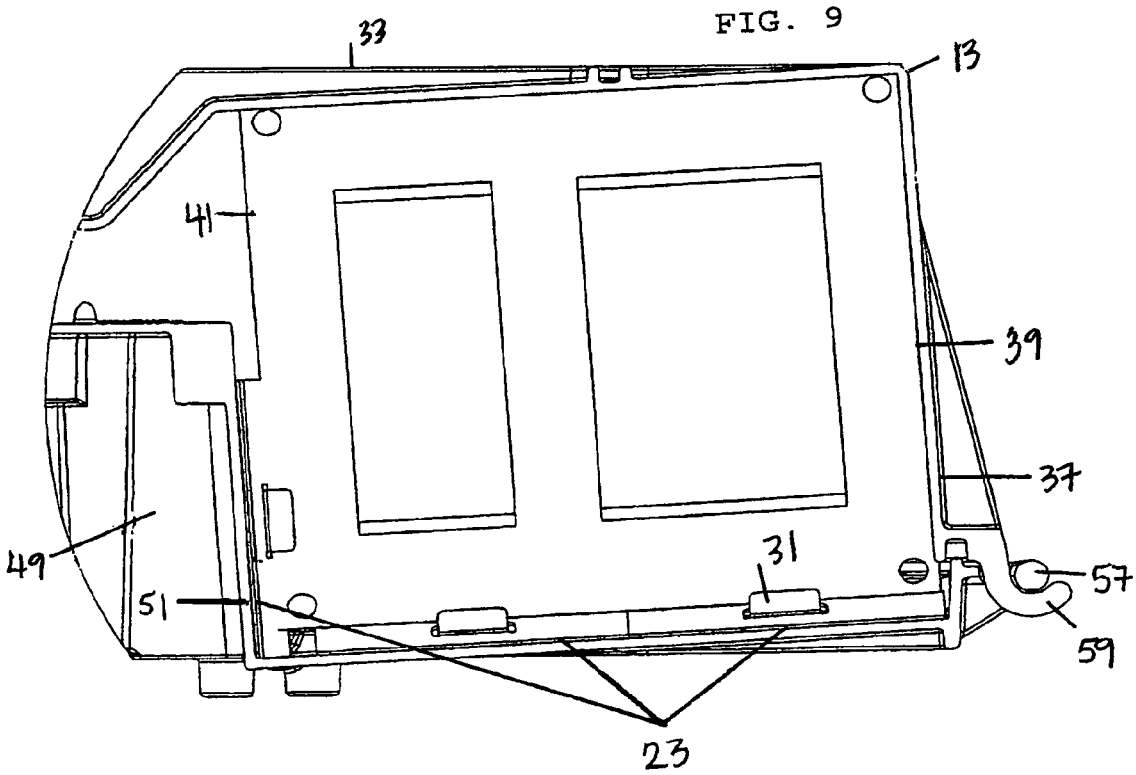
FIG. 9 is yet another partial cross-section of the housing of the device in FIG. 1.

As seen in FIGS. 1 and 4, in one aspect of the invention base member 15 and top member 13, each formed of die-cast metal, are configured to provide mating engagement thereby forming a substantially enclosed space, while allowing essentially unrestricted inflow and outflow of air to cool power-related components within housing 11.

Referring to FIGS. 3 and 6-9, this embodiment employs spring-spacer apparatus 23 positioned between base member 15 and ballast 17 such that, with top member 13 closed with respect to base member 15, spring-spacer apparatus 23 biases ballast 17 into heat-exchange engagement with at least one surface of top member 13 and provides an air gap between ballast 17 and base member 15. Spring-spacer apparatus 23 holds ballast 17 in place while allowing preferential heat transfer to top member 13 and dissipation therefrom to the atmosphere.

Spring-spacer apparatus 23 is a leaf-spring spacer. As best seen in FIGS. 5-9, in one embodiment of the invention, the leaf-spring spacer 23 is a plate with a plurality of locator features 31 adapted to engage and position ballast 17.

In another aspect of the invention, top member 13, FIG. 1, includes a top wall 33 and downwardly-extending, space-surrounding sidewalls 35 integral with top wall 33. Spring-spacer apparatus 23 biases ballast 17 into heat-exchange engagement with top wall 33.

Sidewalls 35 include endwall 37 adjacent to a first side 39 of ballast 17. Base member 15 includes a first upwardly-extending middle portion 51 opposed to endwall 37 and adjacent to a second side 41 of ballast 17 that is opposite first side 39 thereof. Spring-spacer apparatus 23 further biases ballast 17 into heat-exchange engagement with endwall 37.

Referring next to FIGS. 5-8, one embodiment is shown wherein spring-spacer apparatus 23 includes a first spring-spacer member 45 positioned under ballast 17 biasing ballast 17 into contact with top wall 33. Spring-spacer apparatus 23 also includes a second spring-spacer member 47 positioned between first upwardly-extending middle surface 51 of base member 15 and second side 41 of ballast 17 biasing ballast 17 into contact with endwall 37. First and second spring-spacer members, 45 and 47 respectively, are each leaf-spring-spacers.

Referring now to FIGS. 3 and 6-9, in one aspect of the invention base member 15 forms a housing recess 49. Base member 15 has an upwardly-extending middle portion 51 integral therewith which forms housing recess 49. Socket 27 is in recess 49. A portion of spring-spacer apparatus 23 is between first upwardly-extending middle portion 51 and second side 41 of ballast 17, whereby spring-spacer apparatus 23 provides thermal isolation of middle portion 51 of base member 15 from ballast 17.

Portions of housing 11 form a thermal chimney 53 defining a vertical air-flow channel 55 extending through housing 11 from bottom to top. Chimney 53 and upwardly-extending middle portion 51 include a common wall between recess 49 and channel 55 whereby heat transfer to channel 55 and heat-dissipating airflow to the atmosphere are facilitated.

FIGS. 3 and 5-9 illustrate another aspect of the invention where top member 13 is hinged with respect to base member 15 such that hinging motion of top member 13 upon closing housing 11 pushes ballast 17 against spring-spacer apparatus 23. Base member 15 and top member 13 have first and second mating hinge members, 57 and 59 respectively, each integrally formed therewith along adjacent edges thereof.

Before assembly, top member 13 and base member 15 are formed of die-cast metal. First and second spring-spacer members, 45 and 47 respectively, are positioned at their assigned locations. Next, ballast 17 is placed at its assigned location and is secured to first leaf-spring spacer member 45. Capacitor 19 is positioned at its assigned location on a capacitor bed 63 and is secured to base member 15 by a spring-bracket 65.

Socket mount 25 is secured with respect to base member 15. Socket mount 25 supports lamp-mounting socket 27 within housing 11.

Assembly continues by hingedly connecting top member 13 to base member 15. Base member 15 is then secured to top member 13 by first and second hinge members, 57 and 59 respectively, integrally formed therewith. This substantially completes assembly of light fixture 10.

Reflector 29 can be attached to light fixture 10 while preparing for installation at a job site. In some cases, however, reflector 29 may be attached to light fixture 10 immediately upon completion of attachment of base member 15 to top member 13.

When assembly is completed, light fixture 10 is ready for packaging and shipment.

The die-cast metal used in forming top member 13 and base member 15 is preferably aluminum. Acceptable power-related components and other components used in manufacture of light fixture 10 are known to those skilled in the art.

The low profile which is made possible by recessing socket 27 into housing 11 allows the vertical dimension of housing 11 to be as low as 4.5 to 6 inches, even when using electrical components which are standard in overhead industrial light fixtures.

While the principles of this invention have been described in connection with specific embodiments, it should be understood clearly that these descriptions are made only by way of example and are not intended to limit the scope of the invention.

The invention claimed is:

1. In an industrial light fixture having: a housing with a base member and a top member together forming a space; power-related components in the space, including at least a ballast; and a lamp-mounting socket, the improvement comprising spring-spacer apparatus positioned between the base member and the ballast, the spring-spacer apparatus having a flat ballast-supporting portion and an angled base-member-engaging portion, the portions biased away from the base member by spring action of the spring-spacer apparatus such that with the top member closed with respect to the base member, the spring-spacer apparatus biases the ballast into heat-exchange engagement with at least one surface of the top member and provides an air gap between the ballast and the base member, thereby holding the ballast in place while allowing preferential heat transfer to the top member and dissipation therefrom to the atmosphere.

2. The industrial light fixture of claim 1 wherein the base member and the top member are each of die-cast metal.

3. The industrial light fixture of claim 2 wherein the base member and the top member are configured to provide mating engagement thereby forming a substantially enclosed space.

4. The industrial light fixture of claim 1 wherein the spring-spacer apparatus is a leaf spring-spacer.

5. The industrial light fixture of claim 4 wherein the leaf-spring-spacer is a plate with a plurality of locator features adapted to engage and position the ballast.

6. The industrial light fixture of claim 1 wherein:

the top member includes a top wall and downwardly-extending, space-surrounding sidewalls integral with the top wall; and the spring-spacer apparatus biases the ballast into heat-exchange engagement with the top wall.

7. The industrial light fixture of claim 6 wherein the base member and the top member are each of die-cast metal.

8. The industrial light fixture of claim 7 wherein the base member and the top member are configured to provide mating engagement thereby forming a substantially enclosed space.

9. The industrial light fixture of claim 6 wherein:

the sidewalls include an endwall adjacent to a first side of the ballast;

the base member includes a first upwardly-extending surface opposed to the endwall and adjacent to a second side of the ballast that is opposite the first side thereof; and the spring-spacer apparatus further biases the ballast into heat-exchange engagement with the endwall.

10. The industrial light fixture of claim 9 wherein the spring-spacer apparatus includes:

a first spring-spacer member under the ballast biasing the ballast into contact with the topwall; and a second spring-spacer member between the first upwardly-extending surface of the base member and the second side of the ballast biasing the ballast into contact with the endwall.

11. The industrial light fixture of claim 10 wherein the base member and the top member are each of die-cast metal.

12. The industrial light fixture of claim 11 wherein the base member and the top member are configured to provide mating engagement thereby forming a substantially enclosed space.

13. The industrial light fixture of claim 10 wherein each of the first and second spring-spacer members is a leaf-spring-spacer.

14. The industrial light fixture of claim 9 wherein:

the base member has an upwardly-extending middle portion integral therewith which forms a housing recess and the first upwardly-extending surface of the base member;

the socket is in the recess; and a portion of the spring-spacer apparatus is between the first upwardly-extending surface and the second side of the ballast, whereby the spring-spacer apparatus provides thermal isolation of the middle portion of the base member from the ballast.

15. The industrial light fixture of claim 14 wherein the spring-spacer apparatus includes:

a first spring-spacer member under the ballast biasing the ballast into contact with the topwall; and a second spring-spacer member between the first upwardly-extending surface of the base member and the second side of the ballast biasing the ballast into contact with the endwall.

16. The industrial light fixture of claim 15 wherein the base member and the top member are each of die-cast metal.

17. The industrial light fixture of claim 16 wherein the base member and the top member are configured to provide mating engagement thereby forming a substantially enclosed space.

18. The industrial light fixture of claim 15 wherein each of the first and second spring-spacer members is a leaf-spring-spacer.

19. The industrial light fixture of claim 1 wherein the top member is hinged with respect to the base member such that hinging motion of the top member upon closing the housing pushes the ballast against the spring-spacer apparatus.

20. The industrial light fixture of claim 19 wherein the base member and the top member have first and second mating hinge members each integrally formed therewith along adjacent edges thereof.

21. The industrial light fixture of claim 20 wherein the base member and the top member are each of die-cast metal.

22. The industrial light fixture of claim 21 wherein the base member and the top member are configured to provide mating engagement thereby forming a substantially enclosed space.

23. A power supply module having a base member and a top member together forming a space; power-related components in the space on the base member, including at least a principal power-related component: and a lamp-mounting socket, the improvement comprising spring-spacer apparatus positioned between the base member and the principal power-related component, the spring-spacer apparatus having a flat ballast-supporting portion and an angled base-member-engaging portion, the portions biased away from the base member by spring action of the spring-spacer apparatus such that, with the top member closed with respect to the base member, the spring-spacer apparatus biases the principal power-related component into heat-exchange engagement with at least one surface of the top member and provides an air gap between the principal power-related component and the base member, thereby holding the principal power-related component in place while allowing preferential heat transfer to the top member and dissipation therefrom to the atmosphere.

24. The industrial light fixture of claim 23 wherein the base member and the top member are configured to provide mating engagement thereby forming a substantially enclosed space.

25. The industrial light fixture of claim 23 wherein the spring-spacer apparatus is a leaf-spring-spacer.

26. The industrial light fixture of claim 25 wherein the leaf-spring-spacer is a plate with a plurality of locator features adapted to engage and position the principal power-related component.

27. The industrial light fixture of claim 23 wherein:

the top member includes a top wall and downwardly-extending, space-surrounding sidewalls integral with the top wall; and the spring-spacer apparatus biases the principal power-related component into heat-exchange engagement with the top wall.

28. The industrial light fixture of claim 27 wherein:

the sidewalls include an endwall adjacent to a first side of the principal power-related component;

the base member includes a first upwvardly-extending surface opposed to the endwall and adjacent to a second side of the principal power-related component that is opposite the first side thereof; and the spring-spacer apparatus further biases the principal power-related component into heat-exchange engagement with the endwall.

29. The industrial light fixture of claim 28 wherein the spring-spacer apparatus includes:

a first spring-spacer member under the principal power-related component biasing the principal power-related component into contact with the topwall; and a second spring-spacer member between the first upwardly-extending surface of the base member and the second side of the principal power-related component biasing the principal power-related component into contact with the endwall.

30. The industrial light fixture of claim 29 wherein each of the first and second spring-spacer members is a leaf-spring-spacer.

31. The industrial light fixture of claim 28 wherein:

the base member has an upwardly-extending middle portion integral therewith which forms a housing recess and the first upwardly-extending surface of the base member:

the socket is in the recess; and a portion of the spring-spacer apparatus is between the first upwardly-extending surface and the second side of the principal power-related component, whereby the spring-spacer apparatus provides thermal isolation of the middle portion of the base member from the principal power-related component.

32. The industrial light fixture of claim 31 wherein the spring-spacer apparatus includes:

a first spring-spacer member under the principal power-related component biasing the principal power-related component into contact with the topwall; and a second spring-spacer member between the first upwardly-extending surface of the base member and the second side of the principal power-related component biasing the principal power-related component into contact with the endwall.

33. The industrial light fixture of claim 32 wherein each of the first and second spring-spacer members is a leaf-spring-spacer.

34. The industrial light fixture of claim 33 wherein the top member is hinged with respect to the base member such that hinging motion of the top member upon closing the housing pushes the principal power-related component against the spring-spacer apparatus.

35. The industrial light fixture of claim 34 wherein the base member and the top member have first and second mating hinge members each integrally formed therewith along adjacent edges thereof.

* * * * *